US005375374A

United States Patent [19]

Rohroff, Sr.

[11] Patent Number: 5,375,374

[45] Date of Patent: Dec. 27, 1994

[54] COMBINATION MANUAL AND ELECTRIC DOOR OPENER

[76] Inventor: Harry Rohraff, Sr., 1690 Ashton, Walled Lake, Mich. 48088

[21] Appl. No.: 162,713

[22] Filed: Dec. 6, 1993

[51] Int. Cl.[5] ..... E05F 15/10

[52] U.S. Cl. ..... 49/340; 49/25; 49/139; 49/280

[58] Field of Search ..... 49/340, 339, 139, 140, 49/280, 25

[56] References Cited

U.S. PATENT DOCUMENTS

| | | | |
|---|---|---|---|
| 1,064,648 | 6/1913 | Hohne et al. | 49/280 |
| 2,540,538 | 2/1951 | Matchett | 49/340 |
| 3,398,484 | 8/1968 | Katsumura et al. | 49/340 X |
| 4,771,218 | 9/1988 | McGee | 49/280 X |
| 4,934,203 | 6/1990 | Bailey et al. | 49/340 X |
| 4,979,261 | 12/1990 | Lasier et al. | 49/340 X |
| 5,251,400 | 10/1993 | Schultze | 49/340 X |

*Primary Examiner*—Philip C. Kannan

*Attorney, Agent, or Firm*—Gifford, Groh, Sprinkle, Patmore and Anderson

[57] ABSTRACT

A combination manual and electric door opener having a bracket mounted to a door frame at a hinged side of the door. An electric motor is connected to the bracket and in turn connects to a threaded rod. A threaded nut is positioned around the threaded rod. Connected to the threaded rod is a cam arm. Upon engagement by the motor, the threaded nut rotates in a translational direction along the threaded rod. The cam arm is pivoted about a pivot point fastened to the top of the doorway and engages a closed door. The door is thus pivotally acted upon until it is in an open position.

9 Claims, 2 Drawing Sheets

COMBINATION MANUAL AND ELECTRIC DOOR OPENER

BACKGROUND OF THE INVENTION

1. Field of the Invention

The present invention relates generally to a door opening apparatus and, more particularly, to a combination manual and electric door opener.

2. Description of the Prior Art

Various door opening mechanisms are known in the prior art. Such devices typically comprise a bracket mechanism extending between a door and a doorway and a means for generating a force against a door by such a bracket mechanism for the purpose of encouraging pivotal rotation of the door.

The amount of force required to pivotally open a door is usually an inverse proportion to the leverage that a door opening mechanism will apply. Prior art door opening mechanisms are often constructed so that they engage a door at a point fairly close to the hinged connection. As a consequence of this only a small leverage effect is attained. Therefore, the mechanical/electrical means for opening the door necessarily must be designed to impart considerable force on the door in order for the door to pivotally open. Other drawbacks with prior art door openers also include the lack of means for detecting and determining the adequacy of opening of a door, as well as the ability and ease of closing the door after it has been opened.

SUMMARY OF THE PRESENT INVENTION

The present invention provides a combination manual and electric door opener which overcomes the above mentioned disadvantages of the prior art devices.

In brief, The door opener of the present invention comprises a door hingedly connected to a door frame. The door has a hinged side and a latched side. Fastened to the door frame at the hinged side of the door is a bracket, having an electric motor pivotably hinged thereto. The motor is preferably of an elongated cylindrical shape and extends in a direction generally parallel to the direction of the door when the door is in a closed position. The motor has a rotary output shaft which extends from the end of the motor. The output shaft is connected to one end of a threaded rod by a coupling. A threaded nut is threadably received on the threaded rod so that translational motion of the threaded nut may be achieved by rotation of the threaded rod. The threaded nut is pivotably attached to one end of a first arm of a cam lever which extends at an angle from the threaded nut in a first direction relative to the door frame. The cam lever has a second arm which extends generally parallel to the surface of the door when the door is closed.

In order for the door opening mechanism to be activated, a signal is emitted by a portable control to a sensor connected to a junction box fastened to the door frame at the hinged side of the door. The signal is simultaneously received by a door latch actuator which actuates a door latch positioned on the latched side of the door. The door latch actuator retracts the door latch in order to unlatch the door. The junction box contains a timing mechanism which terminates the electrical power to the door opener motor once the door achieves an angle approximately 90° with respect to the door frame. Reverse motion for closing the door is also provided by the portable opener. The door may be opened by manually rotating the door knob and manually opening the door without interference by the opening mechanism of the present invention. Effectively the door opening mechanism is transparent to a manual opening of the door.

BRIEF DESCRIPTION OF THE DRAWING

A better understanding of the present invention will be had upon reference to the following detailed description, when read in conjunction with the accompanying drawings, wherein like reference characters refer to like parts throughout the several views, and in which.

DETAILED DESCRIPTION OF A PREFERRED EMBODIMENT OF THE PRESENT INVENTION

Figure 1:
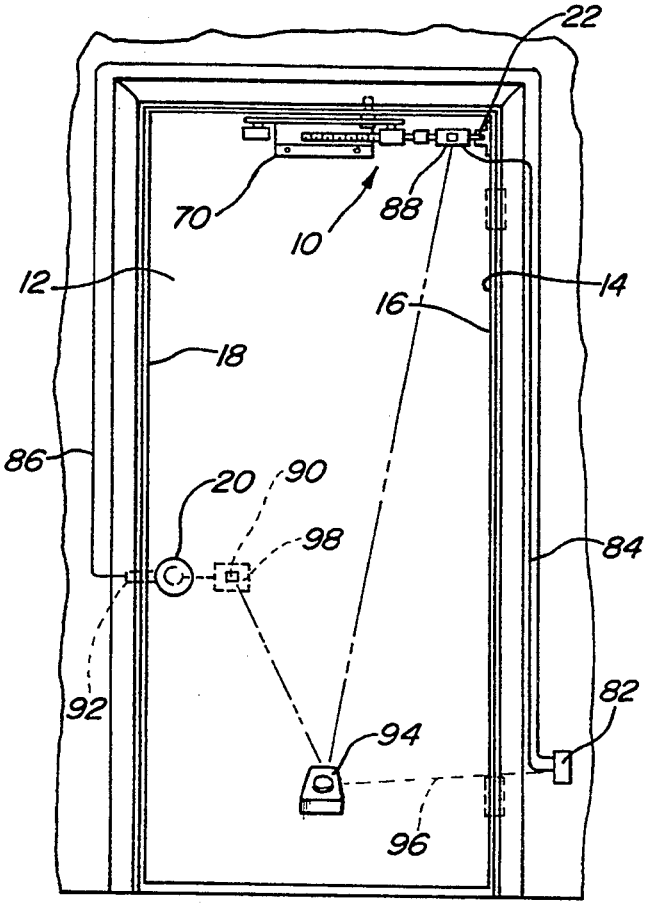
FIG. 1 is a frontal view of the door opener of the present invention.

With respect to FIG. 1, a combination manual and electric door opener 10 having door 12 hingedly connected to a door frame 14 is shown. The door 12 has a hinged side 16 and a latched side 18. The door 12 typically has a knob 20 located near the latched side 18 for manually unlatching the door to pivot about the door frame 14.

Figure 2:
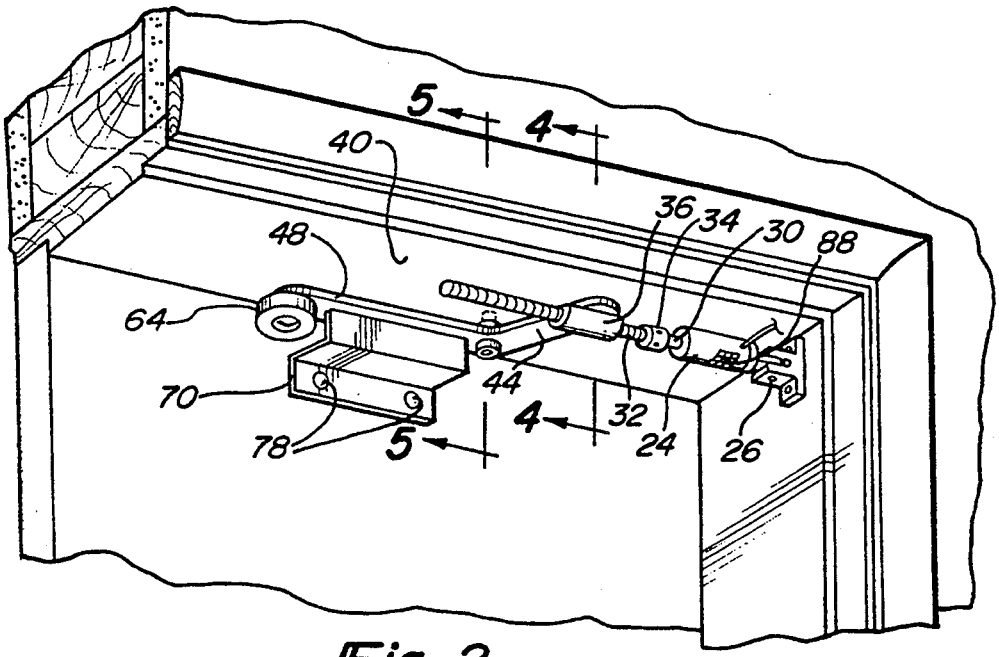
FIG. 2 is a perspective view of the door opener of the present invention.
Figure 3:
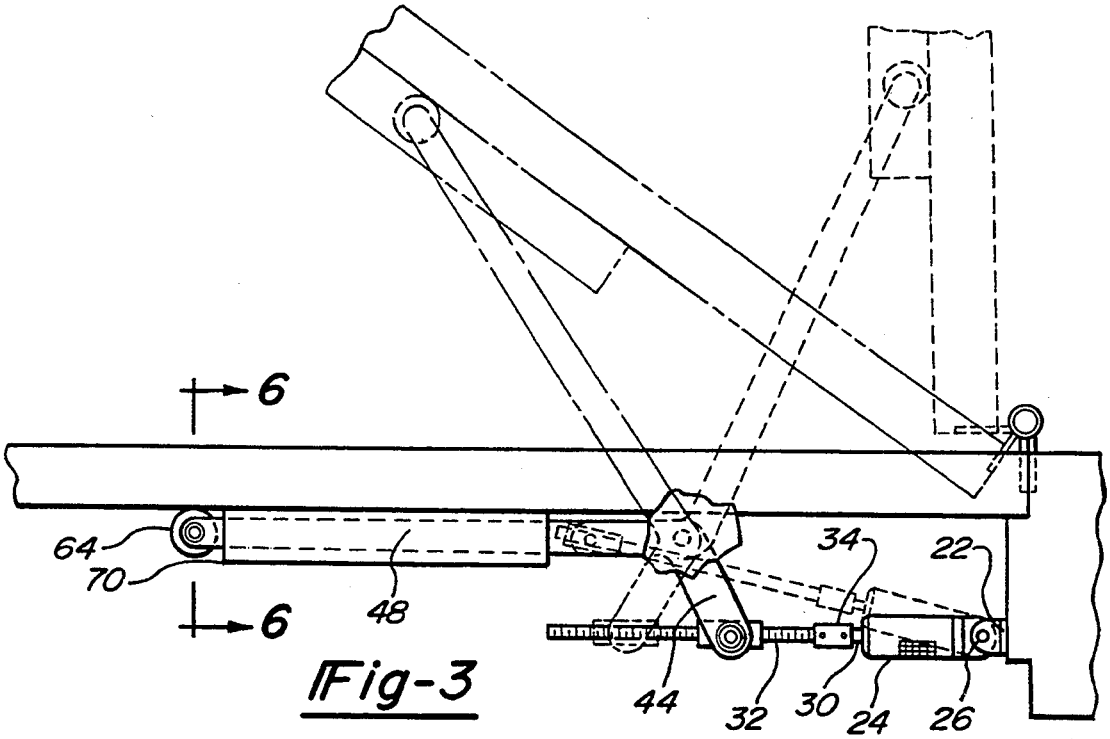
FIG. 3 is a top view of the door opener of the present invention showing the pivotal motion in phantom.

A bracket 22 is affixed to the door frame 14 adjacent to the hinged side 16 of the door 12. The positioning of the bracket 22, as will be indicated later, is crucial to the generation of optimal leverage by the door opener 10 when opening the door 12. Referring to FIGS. 2 and 3, an electric motor 24 is pivotably attached to the bracket 22 by a pivot pin 26. As shown in phantom in FIG. 3, the pivot pin 26 allows the motor 24 to pivot with respect to the fixed bracket 22 when opening the door 12. The electric motor 24 has a rotary output shaft 30 which extends longitudinally from the body of the motor 24.

The output shaft 30 of the electric motor 24 is connected to a threaded rod 32 by means of a coupling 34. The coupling 34 secures the threaded rod 32 in abutting contact with the output shaft 30. As a result, the threaded rod 32 is a longitudinal extension of the output shaft 30.

A threaded nut 36 is threadably received on the threaded rod 32 so that threads of the threaded nut 36 engage the threads of the threaded rod 32. The threaded nut 36 has a hollow cylindrical shape and extends only partly along the length of the threaded rod 32. A first arm 44 of a cam lever 40 has one end pivotably connected to the threaded nut 36. A second arm 48 of cam lever 40 connects to other end of the first arm 44 and extends at an angle with respect to the first arm 44 so that it is parallel to the plane of the door 12 when the door 12 is in a closed position as shown in FIGS. 2 and 3.

Figure 4:
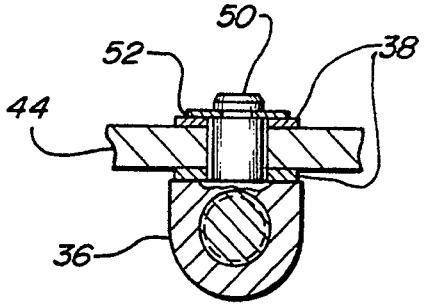
FIG. 4 is a sectional view taken along line 4—4 of FIG. 2.

Referring to FIG. 4, the first arm 44 of the cam lever is pivotably connected to the threaded nut 36 by a vertically disposed pivot pin 50 attached to the threaded nut 36. A snap ring 52 is received in an annular recess provided in the pin 50 to lock the one end of the first arm 44 of the cam lever 40 to the threaded nut 36. Washers 38 are provided on opposite sides of the first arm 44 to permit the one end of the cam lever 40 to freely pivot relative to the threaded nut 36.

Figure 5:
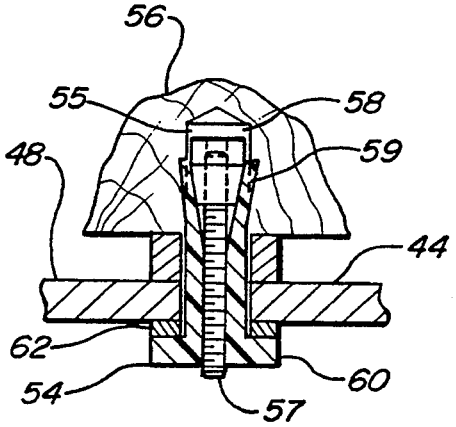
FIG. 5 is a sectional view taken along line 5—5 of FIG. 2.

Referring to FIG. 5, a capped pivot pin 54 pivotably connects the cam lever 40 to a top 56 of the door frame 14. The capped pivot pin 54 is disposed through an aperture provided in the cam lever 40 at the junction between the first and second arms 44 and 48 respectively and is secured to the top 56 of the door frame 14 by a plug 58. The plug 58 has a truncated conical surface which wedges open an end 59 of the capped pivot pin 54 to lock the capped pivot pin 54 in an aperture 55 provided in the top 56 of the door frame 14. A screw 57 displaces the plug 58 to wedge open the end 59 of the capped pivot pin 54. Alternatively, a threaded bolt, may be used in place of the capped pivot pin 54 as is known in the art. A washer 62 is disposed between a cap 60 of the capped pivot pin 54 and the cam lever 40 to permit the cam lever 40 to freely rotate and pivot during opening and closing of the door 12.

Figure 6:
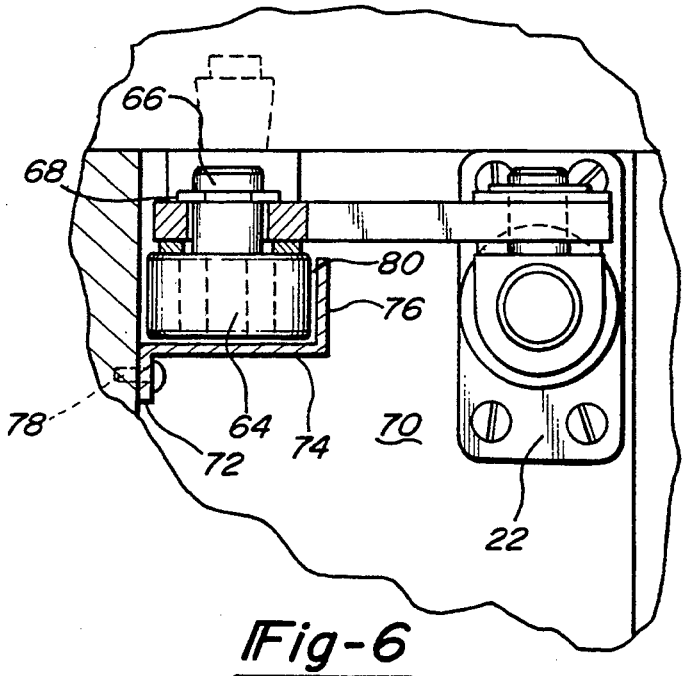
FIG. 6 is a side view of the present invention taken along line 6—6 of FIG. 3.

Referring to FIGS. 2, 3 and 6, a roller 64 is fastened to the end of the cam arm 48 by means of a shaft 66 and second snap ring 68 as shown in FIG. 6. The roller 64 engages the surface of the door 12 and opens the door 12 as the door opener mechanism 10 is activated. A small amount of pre-travel, preferably about one-eights of an inch, exists between the roller 64 and the door 12 and assists in opening the door 12. The electric motor 24 is bi-directional permitting both opening and closing when assisted by appropriate spring biasing means (not shown), of a door 12 as a result of the translational motion imparted to the threaded nut 36 by the rotation of threaded shaft 32, the pivotal motion imparted to the cam lever 40 by the translation of the threaded nut 36 and consequently to the roller 64 engaging the door 12 by the pivotal motion of the cam lever 40.

Referring to FIGS. 2, 3 and 6, a restraining bracket 70 is mounted to the door 12. The bracket 70 is divided into a mounting portion 72, an extending portion 74 and an angled end portion 76. The mounting portion 72 is mounted to the door 12 by a pair of bolts 78 which extend through apertures in the mounting portion 72. The extending portion 74 extends from the door 12 beneath the roller 64 and the cam arm 48. The angled end portion 76 extends perpendicularly and upwardly from the extending portion 74. The angled portion 76 and the door 12 surround the roller 64 and the cam arm 48 and define a channel 80 within which the roller 64 travels. The purpose of the restraining bracket 70 is to maintain contact between the roller 64 and the door 12 and to prevent the door 12 from being swung open by the wind and away from the door opener 10. Accordingly, contact is ensured between the opener 10 and door 12 during both opening and closing of the door.

As shown in FIG. 1, a junction box 82 is secured to the door frame 14 at the hinged side 16 of the door 12. Electrical lines 84 and 86 connect the junction box 82 with a first sensor 88 located on the electric motor 24 and a second sensor 90 located on the door 12 adjacent the knob 20. A door latch 92 mounted in the door 12 at latched side 18 engages a latch plate attached to the door frame 14 to prevent the door 12 from freely opening. A portable control 94, capable of being carried by a user, generates a radio signal 96 simultaneously received by the first sensor 88 and second sensor 90. In response to the radio signal 96, the sensor 88 activates the electric motor 24, and the sensor 90 activates a latch actuator 98 to retract the door latch 92 from engagement with the latch plate attached to the door frame 14. Thus, the electric motor 24 will pivot the cam lever 40 simultaneously with the door latch 92. In this manner, the door 12 may be effectively opened. A timing mechanism, such as an electronic timer container within the junction box 82 or a limit switch terminates the electrical power to the motor 24 once the door 12 has pivoted to an acceptable degree, usually approximately 90°, with respect to the door frame 14. When it is desirable to close the door 12, activation of the portable control 94 causes the electric motor 24 to rotate in the opposite direction until the door 12 is closed and deactivates the latch actuator 98 so that the retractable door latch 92 re-engages the latch plate attached to the door frame 14 to latch the door 12 in a closed position.

Having described my invention, many modifications thereto will become apparent to those skilled in the art to which it pertains without deviation from the spirit of the invention as defined in the scope of the appended claims.

We claim:

1. An apparatus for opening and closing a door connected to a door frame, comprising:

a bracket fastened to the door frame;

a bi-directional electric motor attached to said bracket, said motor having a rotatable output shaft extending therefrom;

means activated by said rotary output shaft of said bi-directional motor for pivotally displacing said door between a closed and an open position, said means for pivotally displacing said door comprises a threaded rod having one end longitudinally attached to said output shaft, a threaded nut threadably received on said threaded rod; said threaded nut translatable along said threaded rod Upon the rotation of said threaded rod by said bi-directional electric motor;

a cam lever having a first end fastened to said threaded nut, said cam lever having a first arm and a second arm extending at an angle relative to said first arm, said second arm extending generally parallel to said door when said door is in a closed position, said second arm of said cam lever terminating at a second end at a point adjacent to said closed door; and portable control means for activating said bi-directional electric motor from a remote location.

2. The door opener as described in claim 1, further comprising a first pivot pin attached to said threaded nut which is pivotably received in an aperture provided in said first arm of said cam lever and a first snap ring fastening said first arm to said threaded nut.

3. The door opener as described in claim 1, further comprising a roller fastened to said second end of said cam lever by a second pivot pin and a second snap ring locking said roller to said second end of said second arm, said roller engageable with the surface of said door so as to open said door when said bi-directional electric motor rotates in a first direction.

4. The door opener described in claim 3, wherein said bi-directional motor rotates said output shaft in a second direction to return said door to a closed position.

5. The door opener as described in claim 3, further comprising a restraining bracket mounted to said door, said bracket surrounding said roller and maintaining contact between said roller and said door during opening and closing of said door.

6. The door opener as described in claim 1, wherein said means for activating said door opener includes a junction box secured to said door frame at a first side of said door, said junction box electrically connected to said bi-directional electric motor.

7. The door opener as described in claim 6, further comprising a retractable door latch disposed on said second side of said door, said latch engaging said door frame to latch said door in a closed position, said latch further communicating by a second line with said junction box so as to disengage said door concurrently with the energizing of said electric motor.

8. The door opener as described in claim 7, comprising in addition a timing chip in said junction box, said chip terminating said electric motor when said door is in an open position.

9. The door opener as described in claim 8, comprising in addition a portable control for operating said door opener, said control emitting a radio signal to activate said door opener, said signal received by said junction box.

* * * * *